US006832560B2

(12) United States Patent
Seiler et al.

(10) Patent No.: US 6,832,560 B2
(45) Date of Patent: Dec. 21, 2004

(54) WORK TABLE

(75) Inventors: Mathias Seiler, Loerrach (DE); Martin Pabst, Waldshut (DE)

(73) Assignee: Sedus Stoll AG, Waldshut (DE)

( * ) Notice: Subject to any disclaimer, the term of this patent is extended or adjusted under 35 U.S.C. 154(b) by 203 days.

(21) Appl. No.: 10/054,888

(22) Filed: Jan. 25, 2002

(65) Prior Publication Data

US 2003/0140822 A1 Jul. 31, 2003

(51) Int. Cl.[7] ..... A47F 5/12
(52) U.S. Cl. ..... 108/7; 108/9; 108/50.01
(58) Field of Search ..... 108/6, 7, 8, 9, 108/50.01, 50.02, 50.14; 248/184.1, 129, 132, 122.1, 125.9, 918

(56) References Cited

U.S. PATENT DOCUMENTS

| | | | | | |
|---|---|---|---|---|---|
| 1,363,335 | A | * | 12/1920 | McFarlane | 108/8 |
| 1,933,210 | A | * | 10/1933 | Curtis | 108/50.14 |
| 4,383,486 | A | * | 5/1983 | Reineman et al. | 108/6 |
| 4,566,741 | A | * | 1/1986 | Eriksson et al. | 108/7 |
| 4,632,349 | A | * | 12/1986 | Anstey | 248/918 |
| 4,852,500 | A | * | 8/1989 | Ryburg et al. | 108/50.01 |
| 4,889,301 | A | | 12/1989 | Yerkes | |
| 4,938,153 | A | * | 7/1990 | Maes | 108/6 |
| 5,027,989 | A | * | 7/1991 | Nevius | 108/6 |
| 5,174,223 | A | * | 12/1992 | Nagy et al. | 108/50.01 |
| 5,743,503 | A | * | 4/1998 | Voeller et al. | 248/284.1 |
| 5,918,841 | A | | 7/1999 | Sweere et al. | |
| 6,182,579 | B1 | * | 2/2001 | Chang | 108/50.01 |
| 6,286,794 | B1 | * | 9/2001 | Harbin | 248/918 |
| 6,394,402 | B2 | * | 5/2002 | Coonan et al. | 248/123.11 |

FOREIGN PATENT DOCUMENTS

| | | | | |
|---|---|---|---|---|
| DE | 28 36 655 | | 10/1979 | |
| DE | 81 14 991 | | 8/1981 | |
| DE | 3321298 | * | 12/1984 | 108/6 |
| DE | 195 36 664 | | 4/1997 | |
| DE | 197 46 911 | | 4/1999 | |
| DE | 299 23 396 | | 8/2000 | |
| FR | 2592288 | * | 7/1987 | 108/7 |
| GB | 2112279 | * | 7/1983 | |
| WO | WO 90/15553 | | 9/1990 | |

* cited by examiner

*Primary Examiner*—Lanna Mai
*Assistant Examiner*—Hanh V. Tran
(74) *Attorney, Agent, or Firm*—Oblon, Spivak, McClelland, Maier & Neustadt, P.C.

(57) ABSTRACT

A work table includes a frame with a vertical central column as well as a base and a work surface, which is fastened to a support element. The height and angle of the work surface are adjustable. A joint seating device is provided on an upper end of the central column and a swivel arm is arranged in a pivoting manner about a horizontal axis of the joint seating device. The swivel arm contains another rotary joint, about whose horizontal axis the support element and the work surface connected with it are arranged in a pivoting manner.

9 Claims, 3 Drawing Sheets

WORK TABLE

TECHNICAL FIELD

The invention relates to the field of the furniture industry. It relates to a work table with a height- and tilt-adjustable work table.

STATE OF THE ART

The height for working on conventional office tables is generally designed such that a keyboard can be beneficially operated ergonomically in an upright sitting position.

With the help of familiar table height adjustments it is therefore possible to adjust the height for users of various heights. The height adjustment generally ranges from 68 to 76 cm.

The continuously upright position however is generally associated with problems for the human locomotor system because the intervertebral disks are exposed to increased pressure.

Orthopedics and industrial scientists are therefore calling for as frequent a position change as possible. This prevents on the one hand the static tightening of muscles and premature fatigue, on the other hand it is easier on the intervertebral disks because it causes alternating tightening and relaxing processes for the muscles and the spine.

Work tables have therefore been developed, with which an adjustment of the work surface to the different user situations can be realized so that a user can work selectively while standing up or while sitting.

For example we know from DE 197 46 911 A1 of a desk with a height-adjustable desk frame and a work top that is fastened to the table frame. This work top is additionally equipped with a desk top that is movable in relation to the work top, and a swivel arrangement is provided in order to allow adjustment of the desk top in relation to the work top with regard to its inclination and height through swiveling about an axis of rotation, wherein the pivot axis is positioned outside the table top so that the table top is raised and lowered at the same time as the swivel movement. The swivel arrangement comprises a rigid connecting element that is arranged on the desk frame so as to be able to swivel about the axis of rotation, with this element carrying the desk top, and a hand lever, which engages in the connecting element in the area of the axis of rotation. The disadvantage of this technical solution is the fact that the user is not able to change between a sitting and a standing activity quickly and as required by the respective situation. It is only when this change can occur with one operation that this change can take place as frequently as is ergonomically desired. Additionally, the desk adjustment mechanism is not designed so as to allow a lying working position. For a potential user, however, the change between a sitting working position and phases of lying and standing working positions is particularly important because in the standing working position the spine automatically takes on its natural S-shape, while in the lying position a complete relaxation of the intervertebral disks occurs.

PRESENTATION OF THE INVENTION

The invention represents an attempt to avoid the above-mentioned disadvantages of the familiar state of the art. It is based on the task of developing a work table with a tilt- and height-adjustable work surface, which enables the user easily and quickly to change between upright sitting, almost lying and standing working positions. The operation of a keyboard, e.g. on a notebook computer, should be possible in all three positions without difficulty.

Based on the invention this is accomplished on a work table, consisting of a frame with a vertical central column as well as a base and a height- and tilt-adjustable work surface, which is fastened to a support element, through the fact that at the upper end of the central column a joint seating device is provided, about whose horizontal axis a swivel arm is seated in a pivoting manner, wherein the swivel arm contains another rotary joint, about whose horizontal axis the support element and thus the work surface are seated in a pivoting manner.

The benefits of the invention consist of the fact that it is possible to adjust the work surface easily and quickly to the working height during lying, sitting and standing positions.

It is useful if a leg rest, which is fastened to the central column through a support fork, is incorporated on the central column. This allows the user to rest his legs comfortably in the lying working position.

Furthermore it is useful if the support fork is axially displaceable on the central column and rotatable about the vertical axis because this ensures a height and depth adjustment of the leg rest.

Additionally it is beneficial if the support fork can be rotated about the horizontal axis. This allows an individual adjustment of the inclination of the leg rest.

And finally it is advantageous if the swivel arm and the support element are seated in a continuously pivoting manner about the horizontal axes. This way, individual height adjustments for the above three working position is provided.

It is also beneficial if between the swivel arm and the support element a cable pull is arranged because this enables a synchronous rotating coupling between the two parts. The support element is then always aligned horizontally when the swivel arm is aligned vertically, while the support element is tilted by about 25° when the swivel arm is aligned horizontally.

It is useful when in the swivel arm a blockable gas pressure spring is arranged, which on the one hand is arranged in a bearing at an angle beneath the joint seating device and on the other hand in a bearing roughly in the center in the swivel arm. This arrangement between the central column and the swivel arm causes the gas pressure spring to experience a lift during the swivel motion between the vertical and the horizontal positions of the swivel arm. This lifting movement can be blocked with the gas pressure spring at any random location, which ensures a swivel fixation of the components and thus a fixation of the work surface.

Furthermore it is beneficial if the gas pressure spring in the unblocked state has a gas spring thrust pressure, which compensates for the inherent weight of the work surface, the support element and the swivel arm because the user can then swivel the swivel arm away with little effort.

And finally it is useful if the base contains swivel rollers. The work table can thus be transported without effort.

BRIEF DESCRIPTION OF THE DRAWING

The drawing shows an example of the invention. It shows.

Only elements that are important for gaining an understanding of the invention are shown.

WAYS FOR EXECUTING THE INVENTION

The invention is explained in the following more in detail based on an example and the FIGS. 1 through 5.

Figure 1:
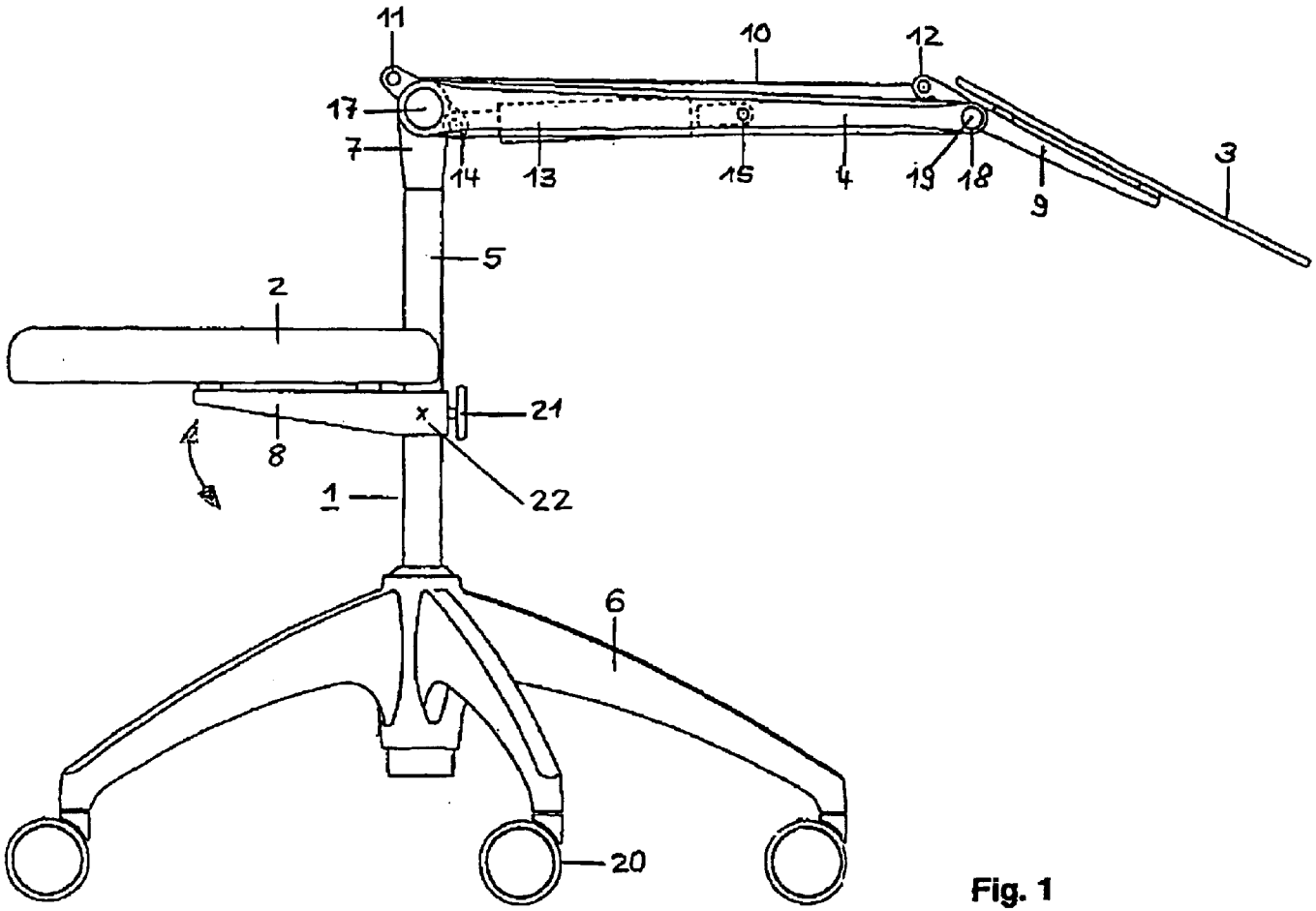
FIG. 1 a side view of an invented work table.
Figure 2:
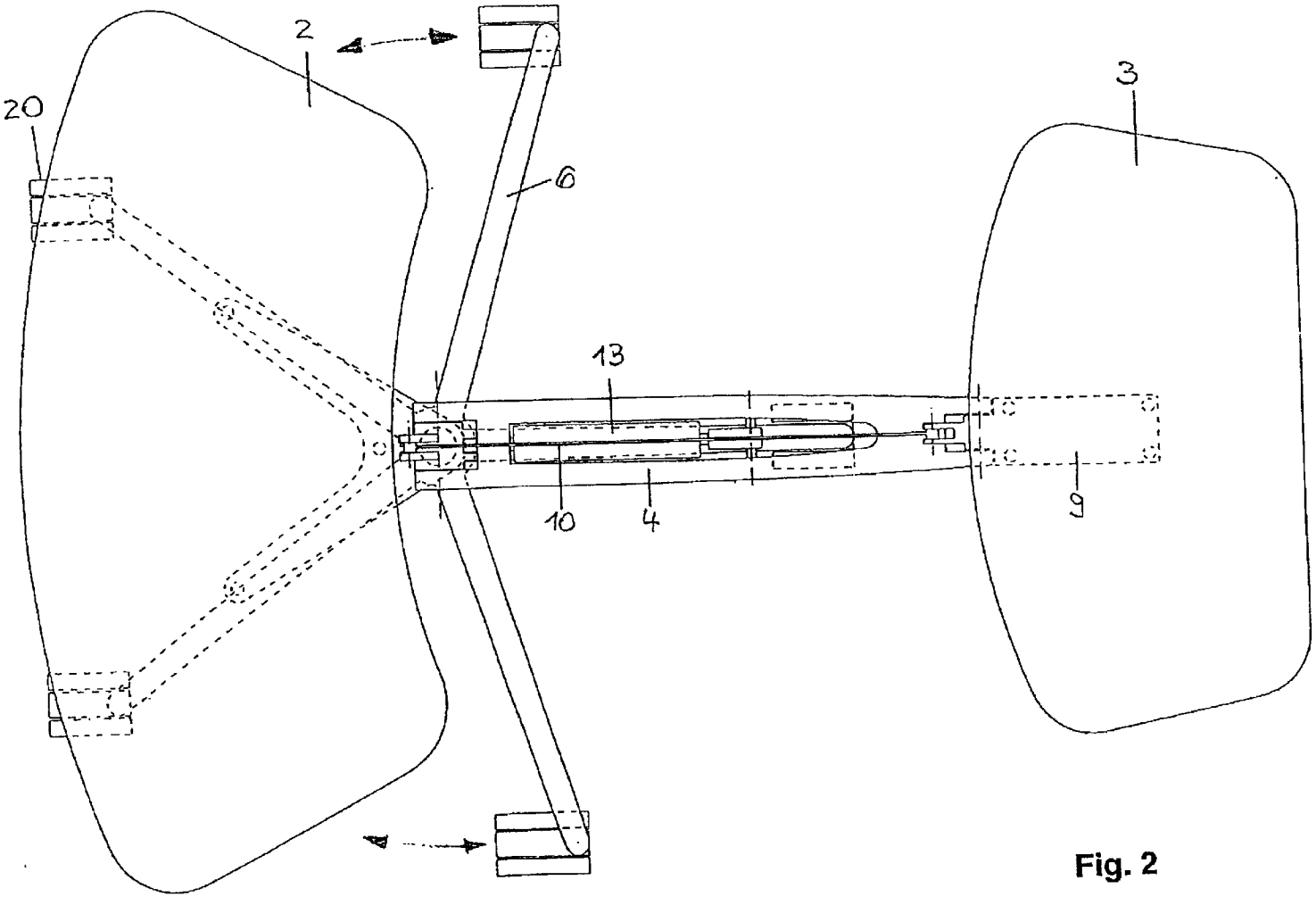
FIG. 2 a top view of an invented work table.

FIG. 1 shows a side view of an invented work table. FIG. 2 shows this table from a top view. The work table consists of a frame 1 with a vertical central column 5, a base 6 as well as a swivel arm 4 and a work surface 3 (shelf), on which a support element 9 is fixed. The work surface 3 and the support element 9 are screwed together in the present embodiment.

The base 6 is equipped with swivel rollers 20 so that the work table can be moved randomly. A leg rest 2 is mounted on the central column 5. The leg rest 2 serves the purpose of allowing the user to rest his legs in the lying working position. The leg rest 2 is screwed together with a support fork 8, which is fixed axially on the central column 5. Fixation occurs via a screw 21 , with which the support fork 8 is connected to the central column 5. The support fork 8 can be shifted and rotated on the central column 5. This guarantees a height and depth adjustment (with 180° rotation) of the leg rest 2. Beyond that, the leg rest 2 can also be rotated in such a way that the legs of the user are positioned selectively to the left or the right of the central column 5. This is indicated in FIG. 2 by the arrows.

In another embodiment, which is not shown, the support fork 8 of the leg rest 2 is seated in a pivoting manner about the horizontal axis 22 so that an individual tilt adjustment of the leg rest is provided.

As shown in FIG. 1, a joint seating device 7 , about whose horizontal axis 17 the swivel arm 4 is seated in a pivoting manner, is arranged at the upper end of the central column 5. The swivel arm 4 contains on its other end another rotary joint 18 , about whose horizontal axis 19 the above-mentioned carrier element 9 and the work surface 3 connected with it are seated in a pivoting manner.

The swivel arm 4 and the support element 9 for the work surface 3 are seated continuously rotatable about the horizontal axes 17 and 19. Through a cable pull 10 a synchronous rotating coupling is ensured between the swivel arm 4 and the support element 9. The lower cable pull fastener 11 is mounted displaceably on the joint seating device 7. The upper cable pull fastener 12 is seated displaceably on the support element 9 of the work surface 3. The position of the axes 17, 19 defines the synchronized relation between the rotation of the swivel arm 14 and the rotation of the support element 9.

Additionally, in the swivel arm 4 a blockable gas pressure spring 13 is arranged, which on one hand is arranged in a bearing 14 at an angle beneath the joint seating device 7 and on the other hand in a bearing 15 roughly in the center of the swivel arm 4 in a pivoting manner. This geometrical arrangement of the gas pressure spring 13 causes the gas pressure spring 13 to experience a lift of about 30 mm during the swivel motion between the vertical and the horizontal positions of the swivel arm 4. This lifting movement can be blocked with the gas pressure spring 13 at any random location, which ensures a swivel fixation of the components and thus a fixation of the work surface 3. Beneficially the unblocked gas spring thrust pressure is designed in such a way that the inherent weights of the work surface 3 , the support element 9 for the work surface 3 and the swivel arm 4 are compensated for and the user can then swivel the swivel arm 4 away with little effort.

Figures 3, 4, 5:
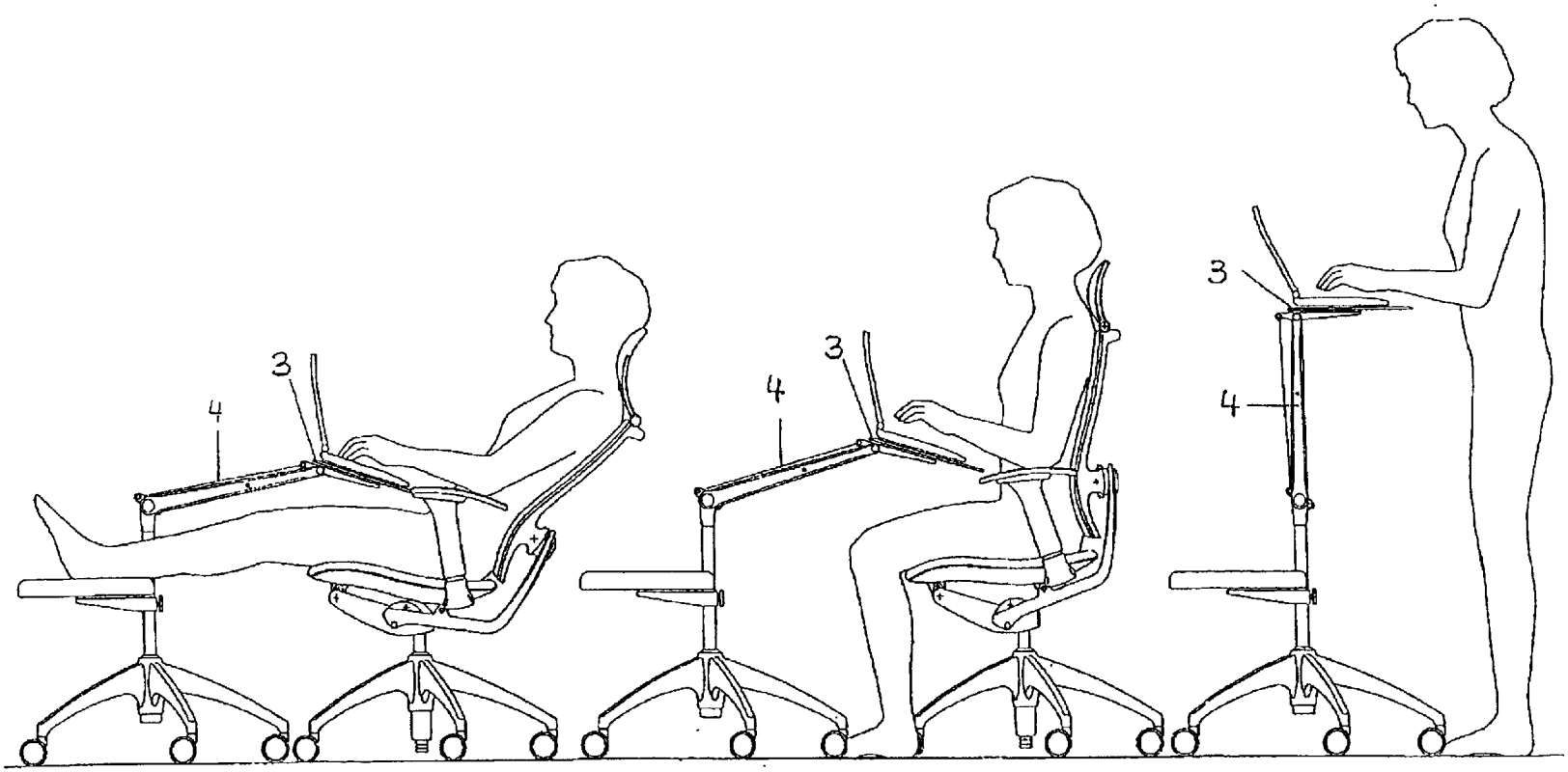
FIG. 3 a side view of an invented work table with a user in the lying working position.
FIG. 4 a side view of an invented work table with a user in the sitting working position.
FIG. 5 a side view of an invented work table with a user in the standing working position.

FIGS. 3 through 5 show the side views of the invented work table with a user in the almost lying, sitting and standing working positions.

If the swivel arm 4 is designed almost horizontally (FIG. 3), the work surface 3 is at such a height that the keyboard resting on top can be operated in a tilted-back, lying position.

If the swivel arm 4 is swiveled slightly upward, then the work surface 3 has a height, which enables the user to assume an upright sitting position (FIG. 4).

If the swivel arm 4 however is swiveled vertically, then the keyboard can be operated by the user in the standing position (FIG. 5).

Since the swivel arm 4 and the support element 9 can be rotated continuously about the horizontal axes, an individually differing height adjustment for the three working position is provided. The synchronous relation, which can be adjusted by the cable pull 10, is designed in such a way that the support element 9 is on one hand aligned horizontally when the swivel arm 4 is aligned vertically (see FIG. 5) and on the other hand the support element 9 is tilted by about 250 when the swivel arm 4 is aligned horizontally (see FIGS. 1, 3).

This not only ensures the respectively ergonomically beneficial inclination of the work surface 3 at each working height, but also guarantees that during the swivel motion the work surface 3 is always aligned such that the keyboard or other objects on the shelf do not fall off.

The invented work table is easy to operate so that for the user a quick change between different working positions is possible without difficulty and an ergonomically favorable workplace can be realized.

Of course the invention is not restricted to the example described.

| Reference List | |
|---|---|
| 1 | Frame |
| 2 | Leg Rest |
| 3 | Work Surface/Shelf |
| 4 | Swivel Arm |
| 5 | Central Column |
| 6 | Base |
| 7 | Joint Seating Device |
| 8 | Support Fork for Pos. 2 |
| 9 | Support Element for Pos. 3 |
| 10 | Cable Pull |
| 11 | Lower Cable Pull Fastening |
| 12 | Upper Cable Pull Fastening |
| 13 | Gas Pressure Spring |
| 14 | Bearing for Pos. 13 |
| 15 | Bearing for Pos. 13 |
| 16 | Screw |
| 17 | Horizontal Axis of Pos. 7 |
| 18 | Rotary Joint |
| 19 | Horizontal Axis of Pos. 4 |
| 20 | Swivel Rollers |

What is claimed is:

1. A work table, comprising:

a frame with a vertical central column fastened to a base on a vertical central axis of the base and a height-adjustable and tilt-adjustable work surface, said work surface being fastened to a support element, a joint seating device is provided on an upper end of the vertical central column, a swivel arm is arranged in a pivoting manner about a horizontal axis of said joint seating device, the swivel arm contains a rotary joint, wherein the support element and the connected work surface are arranged in a pivoting manner about a horizontal axis of said rotary joint; and a cable pull arranged for synchronous rotational coupling between the swivel arm and the support element such that the support element is aligned horizontally when the swivel arm is aligned vertically and the support element is tilted when the swivel arm is aligned horizontally.

2. The work table pursuant to claim 1, wherein on the central column a leg rest is arranged, which is fastened to the central column via a support fork.

3. The work table pursuant to claim 2, wherein the support fork is axially displaceable on the central column and can be rotated about the vertical axis.

4. The work table pursuant to claim 2, wherein the support fork can be rotated about the horizontal axis.

5. The work table pursuant to claim 1, wherein the swivel arm and the support element are seated in a continuously pivoting manner about the horizontal axes.

6. The work table pursuant to claim 1, wherein the synchronous relation between the rotation of the swivel arm and the rotation of the support element is designed in such a way that the support element is tilted by about 25° when the swivel arm is aligned horizontally.

7. The work table pursuant to one of the claims 1 through 5 and 7, wherein in the swivel arm a blockable gas pressure spring is arranged, which on one hand is seated in a bearing at an angle beneath the joint seating device and on the other hand in a bearing roughly in the center of the swivel arm.

8. The work table pursuant to claim 7, wherein the gas pressure spring in an unblocked state has a gas spring thrust pressure, which compensates for inherent weights of the work surface, the support element and the swivel arm.

9. The work table pursuant to claim 1, wherein the base is equipped with swivel rollers.

* * * * *